US005738434A

United States Patent [19]

Sun

[11] Patent Number: 5,738,434

[45] Date of Patent: Apr. 14, 1998

[54] FLASH LIGHT

[75] Inventor: Pel Chang Sun, Taichung, Taiwan

[73] Assignee: Regitar Power Co., Ltd., Taichung, Taiwan

[21] Appl. No.: 603,421

[22] Filed: Feb. 20, 1996

[51] Int. Cl.[6] ..... F21L 7/00

[52] U.S. Cl. ..... 362/199; 362/418; 362/287; 362/205

[58] Field of Search ..... 362/197, 199, 362/205, 202, 285, 287, 418, 419, 421, 427, 208

[56] References Cited

U.S. PATENT DOCUMENTS

| | | | |
|---|---|---|---|
| 1,699,927 | 1/1929 | Stearns | 362/199 |
| 2,712,058 | 6/1955 | Grebey et al. | 362/199 |
| 3,286,545 | 11/1966 | Malachowski | 362/421 |
| 4,447,863 | 5/1984 | Fenne | 362/199 |
| 4,777,572 | 10/1988 | Ambasz | 362/199 |

*Primary Examiner*—Thomas M. Sember
*Attorney, Agent, or Firm*—Alfred Lei

[57] ABSTRACT

A flash light is provided in which the rotary positioning mechanism that retains the lamp head holder to the hollow cylindrical handle at any of a variety of angular positions includes a curved stub tube extending from the sloping bottom wall of the lamp head holder. The stub tube has an internally threaded, straight top end and a straight bottom end. The bottom end extends from the top end at an angle and perpendicularly intersects the sloping bottom wall of the lamp head holder. A plurality of circular recesses are formed in the sloping top wall of the hollow cylindrical handle and radially spaced around the center of the sloping top wall. A spring is mounted within the top end of the curved stub tube. A first steel ball is mounted in the bottom end of the curved stub tube, and a second steel ball is mounted within the top end of the curved stub tube and disposed between the first steel ball and the spring. A hold down screw is threaded into the top end of the curved stub tube to hold the spring therein and to force the first steel ball into engagement with one of the circular recesses.

2 Claims, 4 Drawing Sheets

FLASH LIGHT

BACKGROUND OF THE INVENTION

1. Field of the invention

This invention relates to flash lights. More particularly, this invention relates to a flash light which is durable, and can be accurately and positively adjusted to position the lamp head at any one of a series of angular positions.

2. Prior Art

In conventional flash lights, metal springs are commonly used in the lamp head holder to contact the ring contact and tip contact of the lamp bulb. However, because the metal springs tend to wear with use, bad electrical contact results. Furthermore, conventional flash lights commonly use a rotary positioning mechanism to adjustably retain the lamp head holder to the hollow cylindrical handle at any of a variety of angular positions. That rotary positioning mechanism, as shown in FIG. 1, comprises a tube raised from the sloping bottom wall of the lamp head holder at an angle, a spring mounted within the tube, and a steel ball forced by the spring into engagement with one of a set of circular recesses disposed in the sloping top wall of the hollow cylindrical handle. However, because the bottom end of the tube is not raised perpendicularly from the sloping bottom wall of the lamp head holder, the horizontal center line of the steel ball does not coincide with the top surface of the sloping top wall of the hollow cylindrical handle when the steel ball is forced into engagement with a circular recess. When the lamp head holder is turned relative to the hollow cylindrical handle to shift the steel ball from one circular recess to another, a rotary torque is produced against the periphery of the respective circular recess. Therefore, these circular recesses tend to wear with use.

SUMMARY OF THE INVENTION

This invention is directed to an improved flash light.

According to one aspect of the present invention, the rotary positioning mechanism includes a curved stub tube extending from the sloping bottom wall of the lamp head holder and which has an internally threaded, straight top end. The curved stub tube has a straight bottom end extending from the top end at an angle and perpendicularly intersecting the sloping bottom wall of the lamp head holder. A plurality of circular recesses are formed in the sloping top wall of the hollow cylindrical handle and spaced around the center of the sloping top wall. A spring is mounted within the top end of the curved stub tube. A first steel ball is mounted in the bottom end of the curved stub tube, and a second steel ball is mounted within the top end of the curved stub tube and disposed between the first steel ball and the spring. A hold down screw is threaded into the top end of the curved stub tube to hold down the spring and to force the first steel ball into engagement with one of the circular recesses. According to another aspect of the present invention, the lamp head holder comprises an insulative stepped upright tube, a first metal spring mounted on the outside of the stepped upright tube and a second metal spring mounted on the inside of the stepped upright tube. The first and second metal springs are respectively connected to the two opposite ends of the battery by two conductors through a switch, wherein the first metal spring and the second metal spring support the lamp bulb and make contact with the ring contact and tip contact of the lamp bulb respectively.

Other objects of the invention will in-part be obvious, and in-part hereinafter be pointed out.

The invention accordingly consists of features of structures and a method, combinations of elements, arrangement of parts and steps of the method which will be exemplified in the constructions and method hereinafter disclosed, the scope of the application of which will be indicated in the claims that follow.

DETAILED DESCRIPTION OF THE PREFERRED EMBODIMENT

Figure 1:
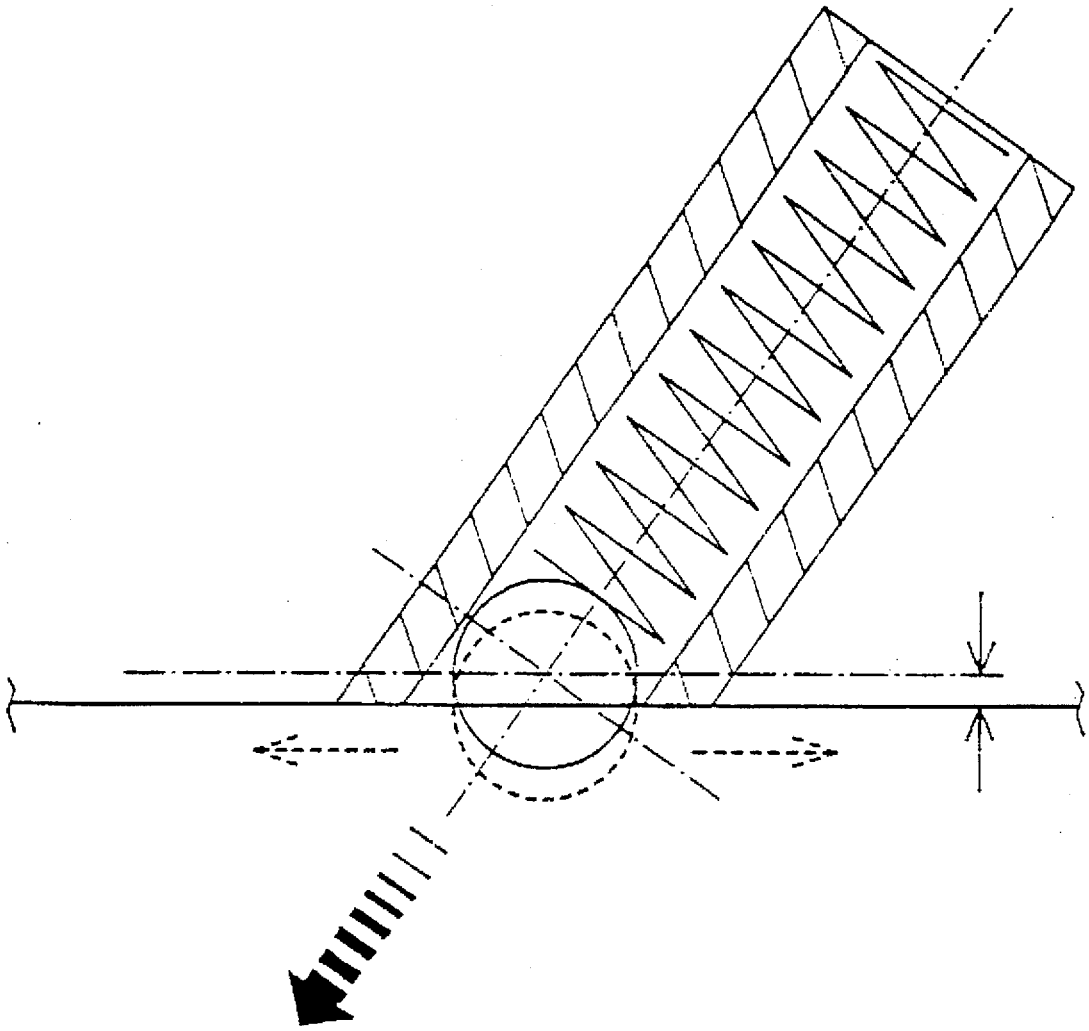
PRIOR ART FIG. 1
FIG. 1 is a schematic drawing showing the rotary positioning mechanism of a prior art flash light.

For the purpose of promoting an understanding of the principles of the present invention, reference will now be made to the embodiment illustrated in the drawings. Specific language will be used to describe the illustrated embodiment. It will, nevertheless, be understood that no limitation of the scope of the invention is thereby intended, and that it is contemplated that such alterations and further modification of the illustrated device, and such further applications of the principles of the invention illustrated herein, as would be recognized by one skilled in the art to which the invention relates are incorporated herein.

Figures 2, 2A:
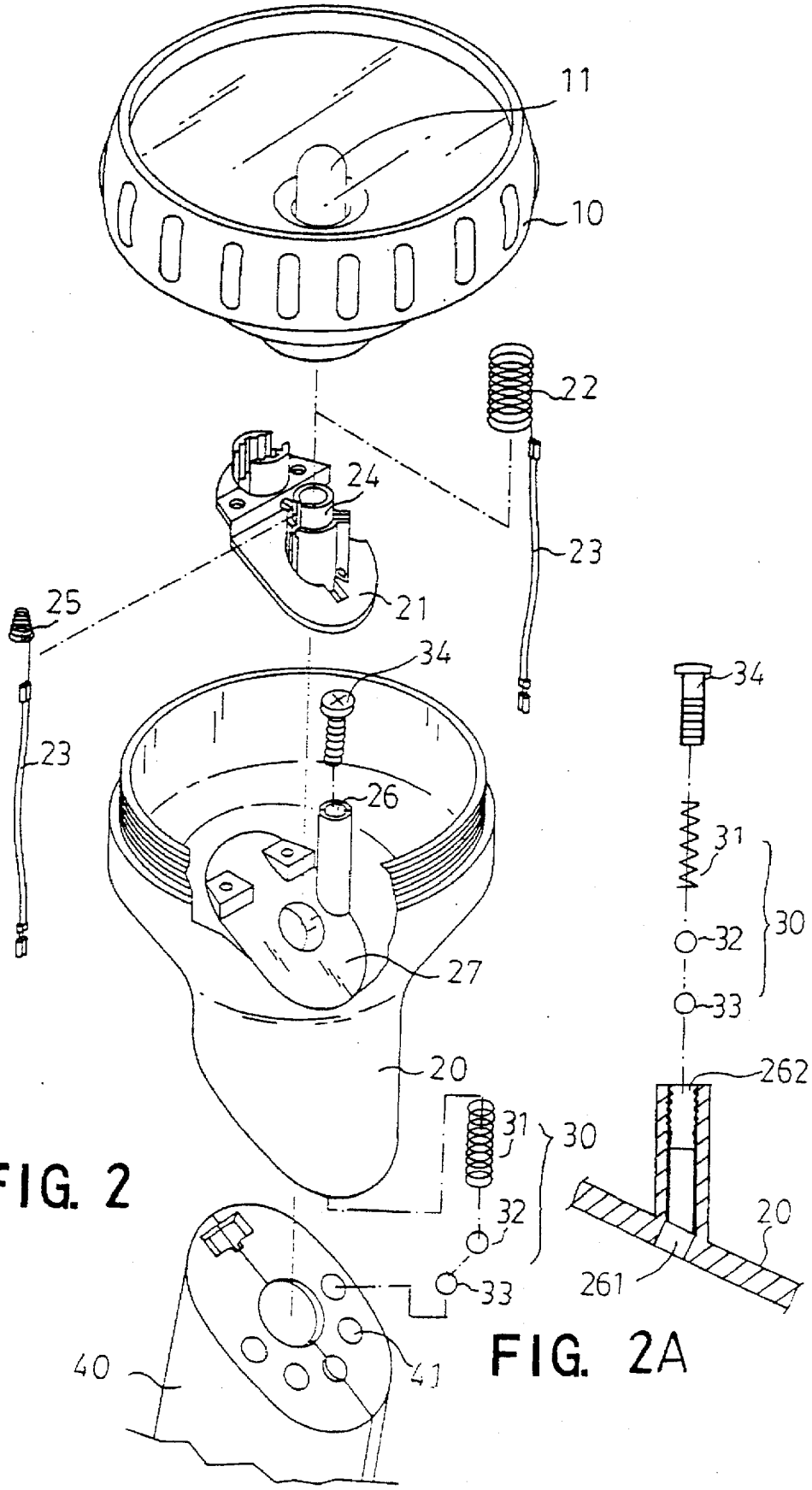
FIG. 2 is an exploded view of a flash light according to the present invention.
FIG. 2A is an exploded view of the rotary positioning mechanism of the flash light shown in FIG. 2.

Referring to FIG. 2, a flash light in accordance with the present invention is generally comprised of a lamp head 10, a lamp bulb holder 21, a lamp head holder 20, and a hollow cylindrical handle 40. The lamp head 10 is fastened to the lamp head holder 20 by a screw joint to hold the lamp bulb holder 21 at the sloping bottom wall 27 of the lamp head holder 20 and a lamp bulb 11 on the lamp bulb holder 21. The lamp bulb holder 21 has an insulative, stepped, upright tube 24. A first metal spring 22 is mounted around the upright tube 24 to support the lamp bulb 11 and to contact the ring contact of the lamp bulb 11. A second metal spring 25 is mounted within the upright tube 24. Two conductors 23 are connected between the metal springs 22, 25 and the two opposing ends of a battery (not shown) disposed in the hollow cylindrical handle 40 through a rotary switch (not shown). The lamp head holder 20 is rotatably coupled to the hollow cylindrical handle 40 and retained at any one of a plurality of angular positions by a rotary positioning mechanism 30.

Referring additionally to FIG. 2A, the aforesaid rotary positioning mechanism 30 is shown to include a curved stub tube 26 extending from the sloping bottom wall 27 of the lamp head holder 20. Stub tube 26 has an internally threaded, straight top end 262 disposed in vertical alignment with the longitudinal central axis of the hollow cylindrical handle 40. Stub tube 26 has a straight bottom end 261 extending from the top end 262 at an angle and perpendicularly intersecting the sloping bottom wall 27 of the lamp head holder 20. A plurality of circular recesses 41 are formed in the sloping top of the hollow cylindrical handle 40 and radially spaced around the center of the sloping top. A spring 31 is mounted within the curved stub tube 26, and two steel balls 32, 33 are mounted within the curved stub tube 26 and forced into engagement with a selected one of the circular recesses 41 by the spring 31. A hold down screw 34 is threaded into the threaded top end 262 of the curved stub tube 26 to hold the spring 31 within stub tube 26. When the lamp head holder 20 is turned relative to the hollow cylindrical handle 40, the bottom steel ball 33 is shifted between the circular recesses 41, the angular position of the lamp head holder 20 thereby being adjusted.

Figure 3B:
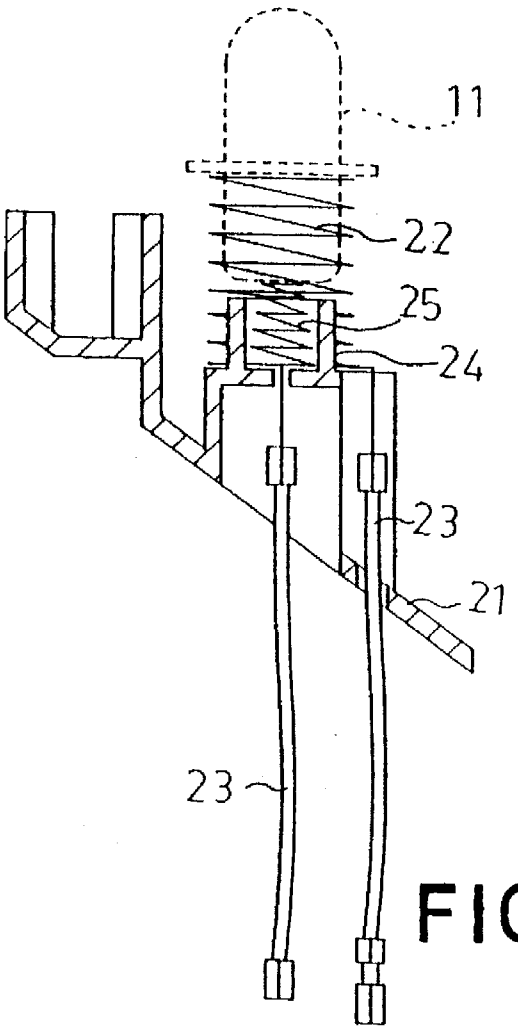
FIG. 3B is similar to FIG. 3A but showing the lamp bulb installed.
Figure 3A:
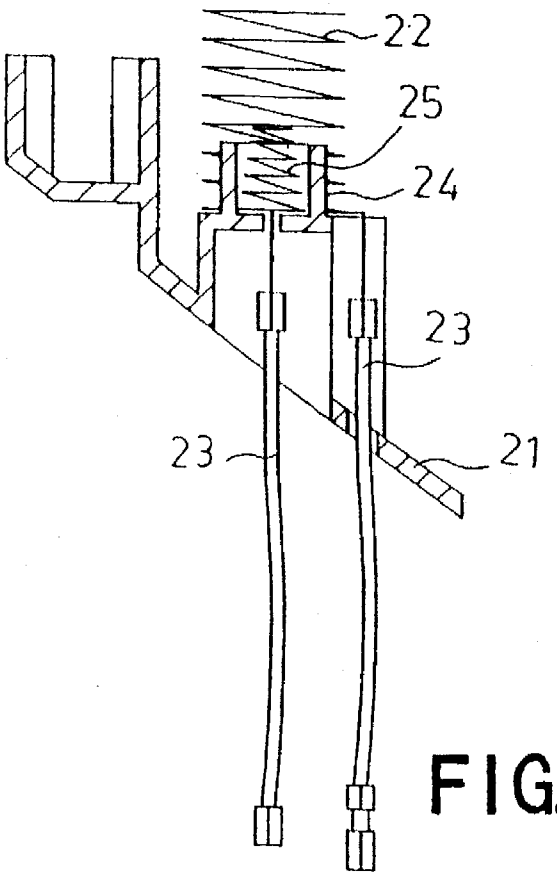
FIG. 3A is a sectional view in an enlarged scale of the lamp bulb holder of the flash light shown in FIG. 2, showing the metal springs mounted in the stepped upright tube and connected to the respective conductors.

Referring to FIG. 3A, the first metal spring 22 is mounted around the exterior of upright tube 24. The second metal spring 25 is mounted within the upright tube 24, and the two conductors 23 are respectively inserted through respective holes in the lamp head holder 21 and connected to the metal springs 22, 25. The opposite ends of the conductors 23 are respectively connected to the two opposite ends of the battery.

Referring to FIG. 3B, the lamp bulb 11 is supported on the first metal spring 22 and the second metal spring 25. The lamp bulb's ring contact and tip contact are respectively connected to the conductors 23 through the first metal spring 22 and the second metal spring 25. When the switch is switched on, the circuit is closed, and battery power is transmitted to the lamp bulb 11, causing the lamp bulb 11 to give off light. Conversely, when the switch is switched off, battery power is cut off from the lamp bulb 11, and thereby turning off the lamp bulb 11. The metal springs 22, 25 are provided to ensure accurate contact between the conductors 23 and the lamp bulb 11. Because the first metal spring 22 is supported on the outside of the upright tube 24 and the second metal spring 25 is supported on the inside of the upright tube 24, the metal springs 22, 25 are not displaced and will not wear quickly with use.

Figure 4B:
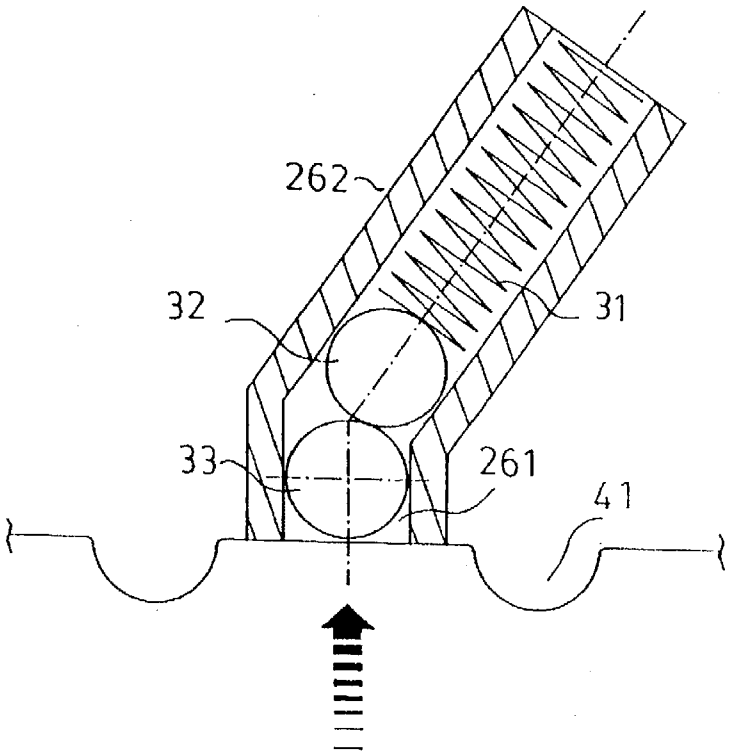
FIG. 4B is similar to FIG. 4A but showing the lower steel ball moved out of the circular recesses.
Figure 4A:
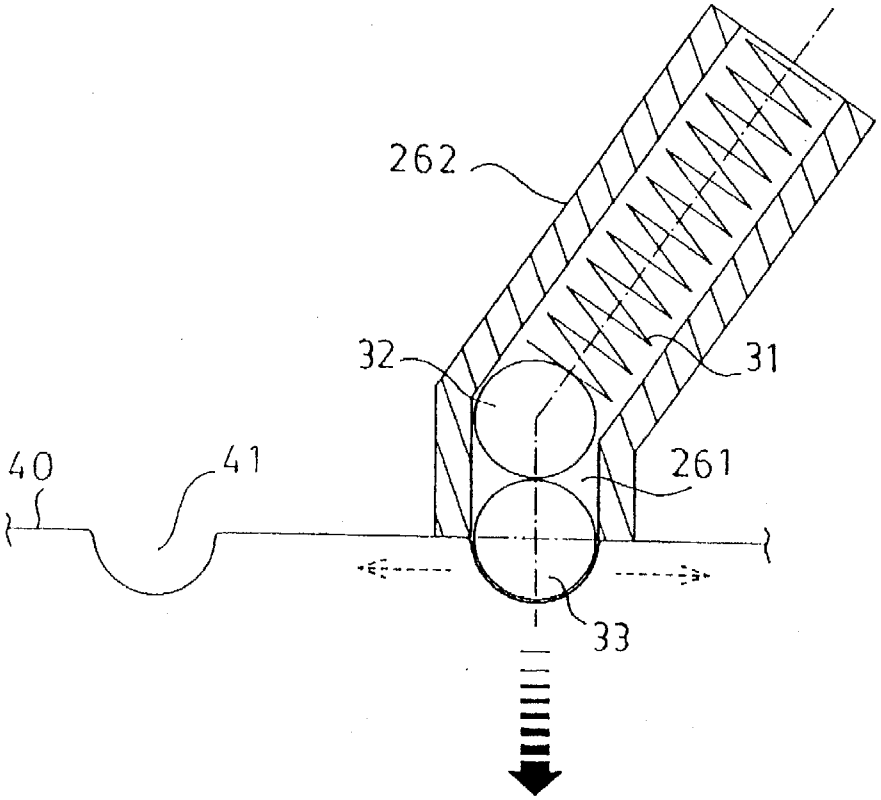
FIG. 4A is a sectional view in an enlarged scale of the rotary positioning mechanism of the flash light shown in FIG. 2, showing the lower steel ball forced into engagement with one circular recess.

Referring to FIGS. 4A and 4B, the spring 31 and steel balls 32, 33 are mounted within the curved stub tube 26, wherein the lower steel ball 33 is retained in the bottom end 261 of the curved stub tube 26 and moved with the lamp head holder 20 between the circular recesses 41 of the hollow cylindrical handle 40. The upper steel ball 32 and the spring 31 are retained in the straight top end 262. The bottom end 261 of the curved stub tube 26 perpendicularly intersects the sloping bottom wall 27 of the lamp head holder 20 (see FIGS. 2 and 2A). By that arrangement the horizontal center line of the steel ball 33 coincides with the bottom surface of the sloping bottom wall 27 of the lamp head holder 20. Therefore, when the lamp head holder 20 is turned relative to the hollow cylindrical handle 40 to move the steel ball 33 between the circular recesses 41, no lateral component of force is produced. Furthermore, because there is not any difference of elevation between the steel ball 33 and the sloping top of the hollow cylindrical handle 40, no torque is produced during the rotary motion of the lamp head holder 20 relative to the hollow cylindrical handle 40. Therefore, the lamp head holder 20 can be smoothly adjusted to the desired angular position.

The present invention is naturally not limited in any sense to the particular features specified in the foregoing description or to the details of the particular embodiment which has been chosen in order to illustrate the present invention. Consideration can be given to all kinds of variations of the particular embodiment which has been described by way of example, and of its constituent elements, without thereby departing from the scope of the invention. This invention accordingly includes all of the means constituting technical equivalents of the means described.

I claim:

1. A flash light comprising a hollow cylindrical handle, a rotary positioning mechanism, a lamp head holder rotatably mounted on said handle and retained in any of a series of angular positions by said rotary positioning mechanism, a lamp bulb holder being mounted within said lamp head holder, a lamp head secured on said lamp head holder to hold a lamp bulb on said lamp bulb holder, two conductors connected to said lamp bulb, said lamp head holder having a sloping bottom wall, said hollow cylindrical handle having a sloping top wall disposed in contact with said sloping bottom wall of said lamp head holder, said rotary positioning mechanism including a curved stub tube extending upwardly from said sloping bottom wall of said lamp head holder, said curved stub tube having an internally threaded, straight top end and a straight bottom end extending from said top end at an angle and perpendicularly intersecting said sloping bottom wall of said lamp head holder, a plurality of circular recesses formed in said sloping top wall of said hollow cylindrical handle and radially spaced around a central portion of said sloping top wall, a spring mounted within said top end of said curved stub tube, a first steel ball mounted in said bottom end of said curved stub tube, a second steel ball mounted within the curved stub tube and disposed between said first steel ball and said spring, and a hold down screw threaded into said top end of said curved stub tube to hold said spring within said curved stub tube and to force said first steel ball into engagement with one of said plurality of circular recesses.

2. The flash light as claimed in claim 1 wherein said lamp bulb holder comprises an insulative stepped upright tube, a first metal spring mounted on an outside surface of said stepped upright tube, and a second metal spring mounted in an interior portion of said stepped upright tube, said first and second metal springs being respectively connected to said two conductors, said first metal spring and said second metal spring being disposed in contact with a respective ring contact and tip contact of said lamp bulb.

* * * * *